United States Patent [19]

Easley

[11] Patent Number: 4,856,666

[45] Date of Patent: Aug. 15, 1989

[54] FOOD COVERING

[76] Inventor: Mary J. M. Easley, P.O. Box 3265, Redding, Calif. 96049-3265

[21] Appl. No.: 199,432

[22] Filed: May 27, 1988

[51] Int. Cl.[4] ..... B65D 41/02

[52] U.S. Cl. ..... 215/272; 215/316

[58] Field of Search ..... 150/52 R; 215/316, 272, 215/326; 383/74, 75

[56] References Cited

U.S. PATENT DOCUMENTS

| | | | |
|---|---|---|---|
| 2,336,950 | 12/1943 | Moss | 150/52 R X |
| 3,475,767 | 11/1969 | Friesen et al. | 383/75 X |
| 4,067,066 | 1/1978 | Bruno | 383/75 X |

*Primary Examiner*—Donald F. Norton

*Attorney, Agent, or Firm*—Leonard D. Schappert

[57] ABSTRACT

A food covering is provided constructed of thin-film material which is substantially impervious to the flow of air and/or water therethrough. The food covering includes a method of tightening the food covering, on a bowl or other receptacle, which may be constructed utilizing either a tightenable string or other tie material passed through a pocket located near the perimeter of the food covering, or slits together with adhesive material to facilitate holding the food covering snugly against a receptacle. A slide-lock may also be utilized to hold the string tight after cinching.

4 Claims, 1 Drawing Sheet

FOOD COVERING

BACKGROUND OF THE INVENTION

1. Field of the Invention.

The present invention relates generally to food covers for use in covering food while it is stored, and more specifically to food covers constructed of relatively thin, flexible plastic material which is sufficiently flexible to facilitate its placement around the top of a pot or bowl in which food has been placed.

2. Description of the Prior Art.

Previous inventors have utilized various thin-film materials to cover foods, including waxed paper and a thin plastic film called Handi-Wrap. Other inventions have included small closable bags with zipper-type closures designed to encase food and keep it fresh, generally known as sandwich bags. While thin-film materials have also been utilized in other areas, such use, because it is not related to foods specifically, is not pertinent to the present disclosure. None of the prior art of which applicant is aware has taught a food cover having the unique features of the present invention.

SUMMARY OF THE INVENTION

The present invention consists of a food covering constructed of thin, flexible plastic or other sheeting material which is substantially impervious to the flow of air and/or water therethrough. In one of the embodiments of the present invention, a string or other tie means is secured about the perimeter of the food covering so that, when the string or other tie means is pulled, the food covering bunches up so that it can be cinched around a bowl or pot in which food has been placed. In another embodiment of the invention, the material of which the food covering is constructed is slit and tape is positioned near each slit so that the food covering can be pulled tightly down over a bowl or pot upon which it is being utilized and then pulled snugly into position and taped in that position. Because thin film is utilized, it may be clear to provide a view of the food stored therein and/or decorated with decorative designs to make it more attractive.

One of the objects of the present invention is to provide an efficient food covering usable with a multitude of vessels.

Another object of the present invention is to provide a thin-film food covering which includes a means of securing it to a bowl or pot on which it is positioned.

Another object of the present invention is to provide a thin-film food covering which includes a simple slide-lock arrangement to maintain a tight fit on a pot or bowl on which it is positioned.

A further object of the present invention is to provide an inexpensive food covering which, by virtue of its low cost, may be utilized once or twice and then thrown away.

The foregoing objects, as wells as other objects and benefits of the present invention, are made more apparent by the descriptions and claims which follow.

DESCRIPTION OF THE PREFERRED EMBODIMENT

Figure 1:
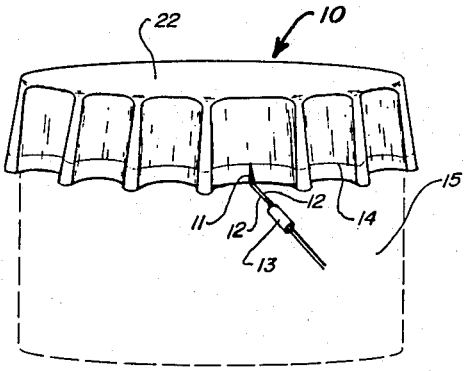
FIG. 1 is a perspective view showing the food covering of the present invention positioned on a pot.

FIG. 1 of the drawings is a perspective view showing food covering 10 positioned on a pot 15 shown in dashed lines and showing how the food covering 10 is positioned thereon. Food covering 10 is constructed of a piece of thin-film material 22 such as a polyethylene film or any food-grade thin-film material which is sufficiently thin, flexible and strong to allow flexing and positioning as shown. Thin-film material 22 having a thickness of between 0.0007 inches and 0.0011 inches was found to work effectively in constructing the food covering 10 of the present invention. Food covering 10 may also be constructed of a thin-film material 22 which is transparent as desired. Food covering 10 is doubled back over itself at its perimeter and sealed as shown by line 14 so that a pocket 24 is formed through which a tie means such as string 12 is passed. Additionally, food covering 10 is slit at 11 to facilitate entry of string 12 into pocket 24. A slide-lock 13 is positioned on string 12 as shown so that, when string 12 cinched tightly, pulling food covering 10 tightly around pot 15, and slide-lock 13 is pushed up against slit 11, food covering 10 is held securely in position on pot 15.

Figure 2:
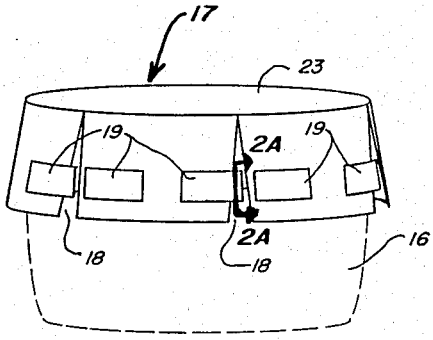
FIG. 2 is a perspective view of the food covering of the present invention showing it positioned on a bowl.

FIG. 2 shows an alternative construction of a food covering 17. The thin-film material 23 of FIG. 2 is of substantially the same structure and thickness as that of FIG. 1 in that it consists of polyethylene film or other food-grade thin, flexible film which is sufficiently structurally strong to maintain its structure while being utilized on a bowl 16 as shown in FIG. 2. Food covering 17 is cut at several places to form slits 18. Several pieces of double-backed tape 19 are provided on food covering 17 near slits 18 so that, when food covering 17 is positioned on a bowl 16 as shown and pulled down as shown, the sections created by slits 18 may be pulled over each other to a point at which the back of one section contacts the doublebacked tape 19 as shown. If the surface covering of double-backed tape 19 has been removed, when the thin-film material 23 of food covering 17 is placed against it, it will hold food covering 17 snugly against bowl 16.

Figure 2A:
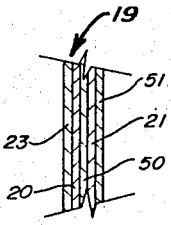
FIG. 2A is a cross-sectional view of the tape of FIG. 2 taken along lines 2A—2A of FIG. 2.

FIG. 2A of the drawings is a cross-sectional view of a portion of food covering 17 taken along lines 2A—2A of FIG. 2 and showing the structure of tape 19. Tape 19 consists of a tape section 50 with adhesive 20 on one side and adhesive 21 on the other side. Adhesive 20 is positioned against the surface of thin-film material 23 of food covering 17. A covering 51, constructed of wax-permeated paper or any other easily removable covering, is positioned on adhesive 21 of tape 19 and may be removed when food covering 17 is ready for use. While double-backed tape is here shown, any adhesive applied directly to thin-film material 23 and covered by a covering 51 would work equally well.

Figure 3:
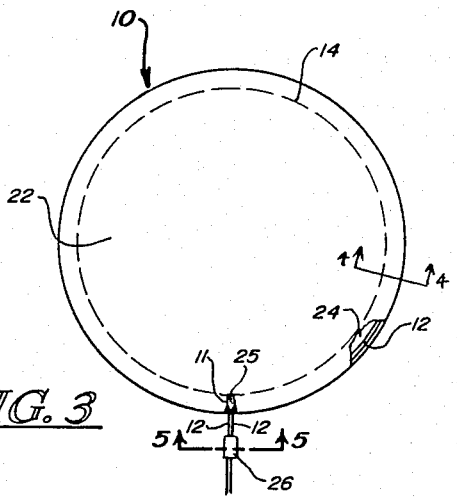
FIG. 3 is a top view showing the shape of the food covering of the present invention when not positioned on a bowl or pot.

FIG. 3 is a top view of food covering 10 of FIG. 1. In FIG. 3, food covering 10 is shown lying flat. Food covering 10 is constructed of thin-film material 22 which is folded along its perimeter to create a pocket 24 through which string 12 extends. After thin-film material 22 is folded over as shown, it is sealed near the perimeter of food covering 10 as shown by dashed line 14. In this particular embodiment, it was found that a substantially round structure was most useful in covering foods in most pans, bowls and other receptacles. However, it could also be constructed in an oval, square or rectangular or other desirable shape, as well as a specific shape adapted to fulfill particular requirements. Food covering 10 is slit at 11 so that string 12 enters pocket 24 at points 25. A slide-lock 26 is provided through which string 12 passes and which, as a result of its sizing and the size of string 12, holds itself in position against food covering 10 when string 12 of food covering 10 is cinched to hold food covering 10 snugly against a pot or bowl.

Figure 4:
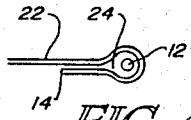
FIG. 4 is a cross-sectional view of a portion of the food covering of FIG. 3 taken along lines 4—4 of FIG. 3.

FIG. 4 of the drawings is a cross-sectional view taken along lines 4—4 of FIG. 3 showing the construction of food covering 10 which provides the pocket 24 through which string 12 fits. The thin-film material 22 is folded over until its end contacts the main part of thin-film material 22 and is sealed at 14 as shown. As a result of this folding and sealing at 14, a pocket 24 is created through which string 12 extends. While glue might be utilized at 14 to create the structure shown, it was found that if thin-film material 22 is heated at 14 to a point at which thin-film material 22 begins to melt, it adheres to itself, thereby attaching the end of thin-film material 22 at 14 as shown.

Figure 5:
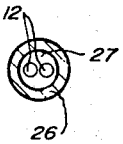
FIG. 5 is a cross-sectional view of the string and slide-lock arrangement of FIG. 3 taken along lines 5—5 of FIG. 3.

FIG. 5 is a cross-sectional view of slide-lock 26 taken along lines 5—5 of FIG. 3. Slide-lock 26 consists of a hollow substantially tubular piece of material such as metal, plastic or any other material which is sufficiently structurally strong to maintain its strength during use. Slide-lock 26 has a hole 27 extending therethrough the size of which is such that, when the ends of string 12 are passed therethrough as shown, slide-lock 26 fits tightly against them, thereby creating friction as they pass therethrough. As a result of this tight fit, slide-lock 26 remains in position when pushed against food covering 10 after string 12 has been cinched to tighten food covering 10 around a pot or bowl. While the slide-lock 26 here shown is of a specific structure, any slide-lock capable of holding string 12 in position can be utilized.

Figure 6:
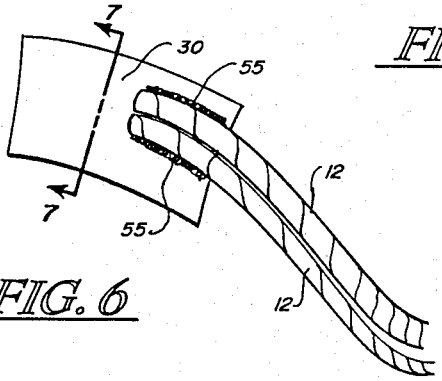
FIG. 6 is a perspective view showing a piece of double-backed tape positioned at the end of the string of FIGS. 1 and 3 which facilitates holding the end of the string or other tie means against a pot or bowl upon which the food covering is being used.

FIG. 6 is a perspective view showing the ends of string 12 attached to a piece of tape 30 by means of an adhesive 55 or any other acceptable attaching means as shown. The purpose of tape 30 is to hold the ends of string 12 against a pot or bowl or against food covering 10 during use so that string 12 is not dangling after food covering 10 has been cinched tight.

Figure 7:
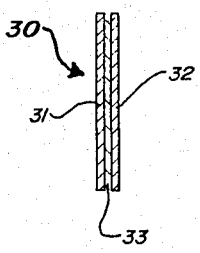
FIG. 7 is a cross-sectional view of the tape of FIG. 6 taken along lines 7—7 of FIG. 6.

FIG. 7 is a cross-sectional view of tape 30 taken along lines 7—7 of FIG. 6. Tape 30 consists of three parts: a piece of structurally strong tape 32 to which the ends of string 12 are attached as shown in FIG. 6; an adhesive 33 positioned on the face of tape 32 as shown; and a tape covering 31, which is generally constructed of a wax-permeated paper or other material which will stick to adhesive 33, but is easily removed prior to use. After removal of tape covering 31, tape 30 may be positioned against a pot or bowl or against thin-film material 22 of food covering 10 to hold it in position.

While the foregoing description of the invention has shown preferred embodiments using specific terms, such description is presented for illustrative purposes only. It is applicant's intention that changes and variations may be made without departure from the spirit or scope of the following claims, and this disclosure is not intended to limit applicant's protection in any way.

I claim:

1. A food covering comprising:

a sheet of thin-film material which is substantially impervious to air and moisture having a top surface and a bottom surface, a perimeter, a center and several slits extending from said perimeter toward said center of said thin-film material forming flaps therebetween;

adhesive material positioned on said top surface of at least one of said flaps of said thin-film material so that, when said bottom surface of one said flap is pressed against said adhesive on said top surface of an adjacent said flap, both of said flaps are held substantially in position with respect to each other, and a protective removable cover tape positioned on said adhesive to facilitate protection of said adhesive until said cover tape is removed.

2. A food covering comprising:

a sheet of thin-film material which is substantially impervious to air and moisture having a perimeter and having a pocket extending substantially about said perimeter of said thin-film material and an opening in said perimeter;

a tie means passed through said pocket, extending around said perimeter of said thin-film material and exiting said pocket at said opening so that, when said tie means is pulled, said perimeter of said thin-film material cinches tightly around a receptacle, and an attaching means positioned on said tie means for holding said tie means in position against said receptacle after said perimeter of said thin-film material has been cinched tightly about said receptacle.

3. A food covering comprising:

a sheet of thin-film material which is substantially impervious to air and moisture having a center and a perimeter, said perimeter of said sheet of thin-film material being folded back toward said center of said thin-film material and being heat sealed, thereby forming a pocket which extends substantially about said perimeter of said thin-film material, further having an opening in said perimeter;

a tie means passed through said pocket, extending around said perimater of said thin-film material and exiting said pocket at said opening so that, when said tie means is pulled, said perimeter of said thin-film material cinches tightly around a receptacle.

4. The invention of claim 3, including a slide-lock means having a hole of sufficiently small size so that said slide-lock means and said tie means are snug when said tie means is passed therethrough.

* * * * *